US006211837B1

(12) United States Patent
Crouch et al.

(10) Patent No.: US 6,211,837 B1
(45) Date of Patent: Apr. 3, 2001

(54) DUAL-WINDOW HIGH-POWER CONICAL HORN ANTENNA

(75) Inventors: David D. Crouch, Corona; William E. Dolash, Montclair, both of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/265,643

(22) Filed: Mar. 10, 1999

(51) Int. Cl.[7] ..... H01Q 13/00
(52) U.S. Cl. ..... 343/786; 343/776
(58) Field of Search ..... 343/786, 909, 343/911 R, 785, 772, 753

(56) References Cited

U.S. PATENT DOCUMENTS 5,039,993 * 8/1991 Dragone ..... 343/776
5,166,698 * 11/1992 Ashbaugh et al. ..... 343/783
5,952,984 * 9/1999 Kuramoto et al. ..... 343/911 R

* cited by examiner

*Primary Examiner*—Don Wong
*Assistant Examiner*—James Clinger
(74) *Attorney, Agent, or Firm*—David W. Collins; Glenn H. Lenzen, Jr.

(57) ABSTRACT

A high power $TM_{01}$ mode radio frequency antenna. The inventive antenna comprises a conical horn for receiving an electromagnetic input signal and radiating an output signal in response thereto. An inner window is disposed within the conical horn. An outer window is mounted at an output aperture of the conical horn in alignment with the inner window. The antenna has a gradual taper from a waveguide input to the aperture over a cone angle of 45 degrees. The outer window is mounted at the aperture in concentric alignment with the inner window. For an optimal compact design, the inner and outer windows are of polycarbonate construction.

13 Claims, 5 Drawing Sheets

DUAL-WINDOW HIGH-POWER CONICAL HORN ANTENNA

This invention was developed in whole or in part with U.S. Government funding. Accordingly, the U.S. Government may have rights in this invention.

BACKGROUND OF THE INVENTION

1. Field of the Invention

The present invention relates to antennas. More specifically, the present invention relates to high power radio frequency antennas.

2. Description of the Related Art

For certain applications, there is a need for a high power radio frequency (RF) antenna capable of radiating large amounts (e.g. 3 gigawatts) of RF power with long pulse durations on the order of one microsecond. Unfortunately, conventional RF antennas are not typically capable of operating effectively at such high power levels. This is due to the fact that at high power levels, the electric field at the output of the antenna is generally so high as to cause the air to break down and ionize. The ionized air conducts and limits the performance of the antenna. Further, the high power sources that could be used with such antennas are typically sensitive to reflections.

In addition, to the extent that conventional antennas have been used for high power applications, the antennas have been driven with short pulses on the order of 100 nanoseconds, for which the air-break down limit is considerably higher than for one microsecond pulses.

Hence, there is a need in the art for a high power RF antenna capable of radiating large amounts of power with long pulses and minimal reflection.

SUMMARY OF THE INVENTION

The need in the art is addressed by the high power radio frequency antenna of the present invention. The inventive antenna comprises a conical horn for receiving an electromagnetic input signal and radiating an output signal in response thereto. An inner window is disposed within the conical horn. An outer window is mounted at the aperture of the conical horn in alignment with the inner window. In the illustrative implementation, the inventive antenna is a $TM_{01}$ mode antenna with a gradual taper from an input waveguide to the aperture over a cone angle of 45 degrees. The outer window is mounted at the aperture in concentric alignment with the inner window. For an optimal compact design, the inner and outer windows are of polycarbonate construction.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
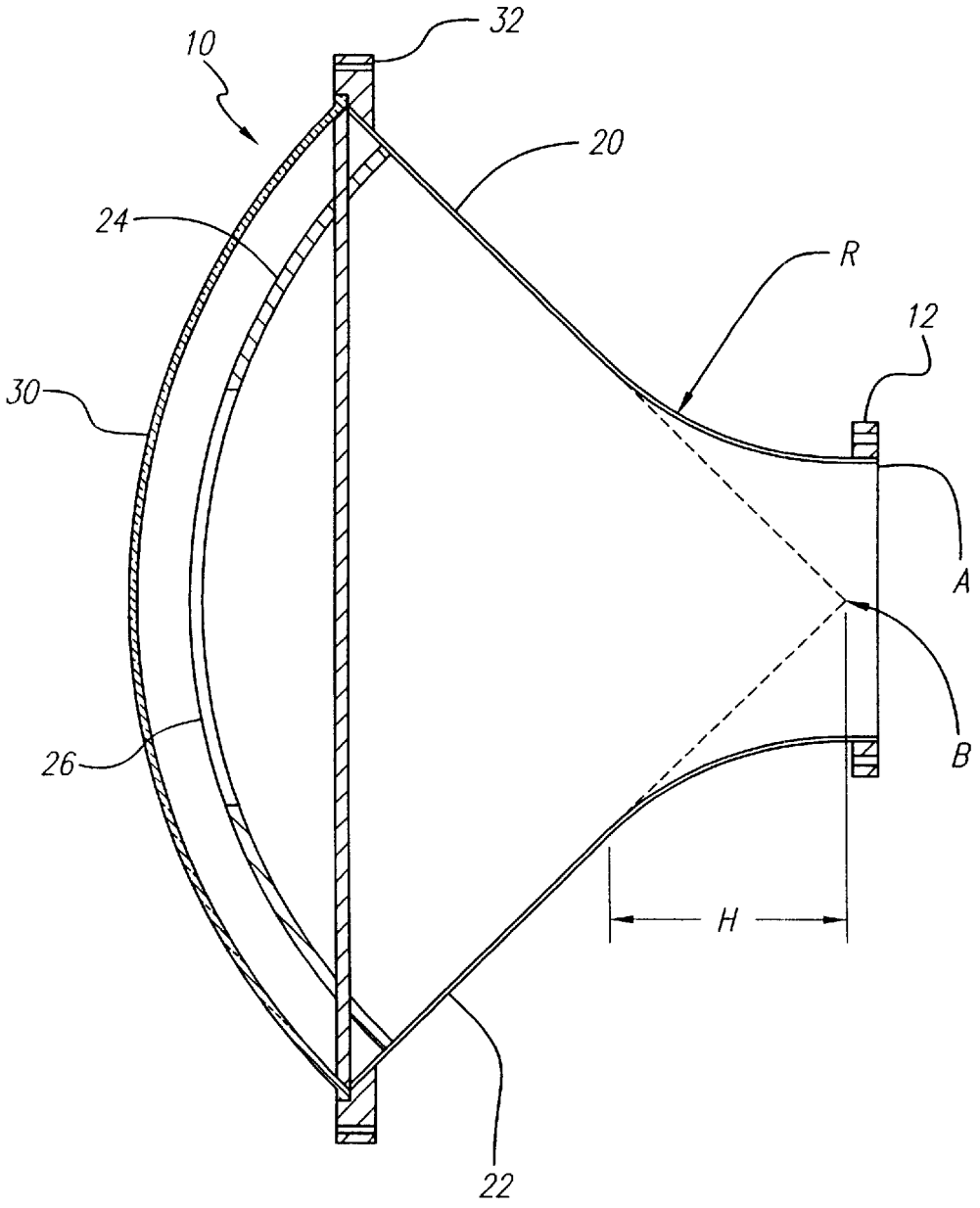
FIG. 1 is a sectional side view of the dual window antenna of the present invention.
Figure 2:
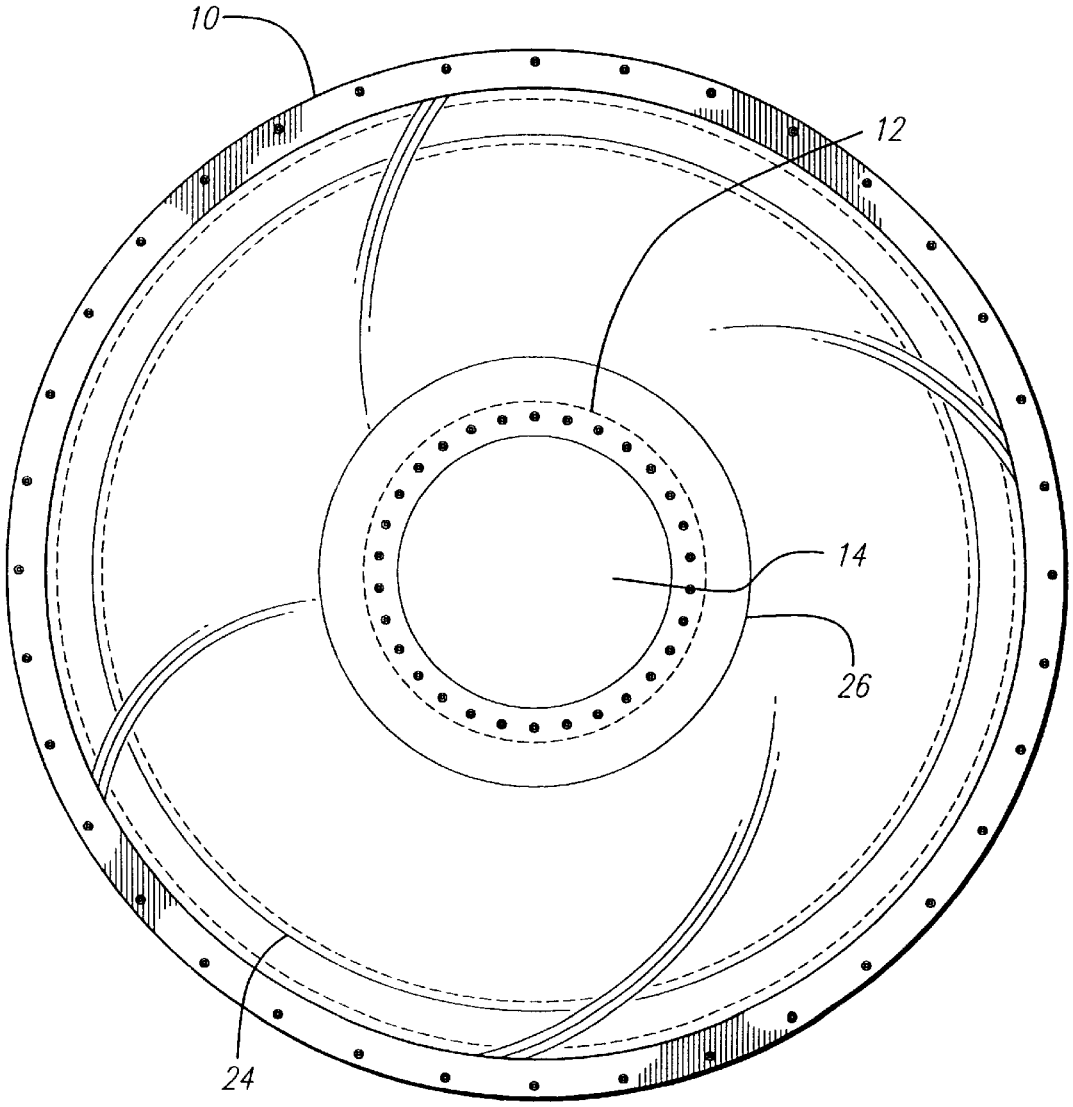
FIG. 2 is an end view into the aperture of the dual window antenna of the present invention.

The present invention is a dual window $TM_{01}$ mode conical horn antenna capable of radiating long pulses at high power. FIG. 1 is a sectional side view of the dual window antenna of the present invention. FIG. 2 is an end view into the aperture of the dual window antenna of the present invention. As shown in FIGS. 1 and 2, the inventive antenna 10 has an input flange 12 disposed at a waveguide input thereof. As best illustrated in FIG. 2, the input flange 12 is an annular ring and has an aperture 14 therethrough. In the illustrative embodiment, the flange 12 is made of aluminum or other suitable material.

As shown in FIG. 1, the input flange 12 is connected to a conical horn 20. The horn 20 has a waveguide input, an aperture, and a gradual taper therebetween to minimize reflection. The criteria for the antenna taper is that it provide a seamless transition from the flange 12 to the conical horn 20 in order to minimize reflections from the transition region. The transition itself has a circular profile, with an interior radius and a height denoted by R and H, respectively, in FIG. 1. The antenna is designed so that the ends of the transition are tangential to the side of the conical horn on one end and to the circular waveguide on the other end as illustrated at point 'A' in FIG. 1. The value of R is determined by $$R = \frac{b\cos\theta_c - \delta\sin\theta_c}{1 - \cos\theta_c}, \qquad [1]$$

where b is the inner radius of the circular waveguide used to feed the horn, $\theta_c$ is the angle between the axis of the cone and the side wall of the cone, and $\delta$ is the distance between the projected apex of the cone and the start of the transition section. Point B in FIG. 1 illustrates the projected cone apex and that the apex coincides with start of transition. The sign of $\delta$ is positive when the cone apex is displaced from the start of the transition section away from the aperture of the conical horn. The height of the transition is $$H = b(1 + \cos\theta_c)\cot\theta_c - \delta\cos\theta_c. \qquad [2]$$

Notice that both R and H increase when $\delta<0$; this makes for a smoother transition and results in a larger return loss (i.e., lower reflections) but it also increases the length of the antenna. To minimize the size of the antenna, a compromise may be made. In the illustrative embodiment, a value of $\delta=0$ was used, resulting in R=13.58" and H=9.6".

The aperture size is chosen to bring down the electric field strength at the output of the antenna below the breakdown threshold of the ambient environment (e.g. air). In the illustrative embodiment, the cone angle 22 between the waveguide input and the aperture is 45 degrees. This facilitates a compact design allowing for a much shorter antenna than an antenna designed in accordance with conventional teachings. In the best mode, the horn 20 is made of a material with high conductivity and good vacuum properties such as 6061 aluminum, stainless steel, or other suitable material.

As shown in FIG. 1, a first (inner) window 24 is bonded within the horn 20 with an acrylic epoxy or other suitable material. In the preferred embodiment, the inner window 24 is made of polycarbonate (i.e. plastic such as "Acrylite FF sold by S & W Plastics") or other suitable material. A second (outer) window 30 is mounted at the aperture of the horn 20. The outer window is made of the same material as the inner window e.g., polycarbonate. The inner window has a bore 26 therethrough to provide an escape path for outgassed particles from the outer window 30. The outer window 30 is seated in a flange 32.

Figure 3:
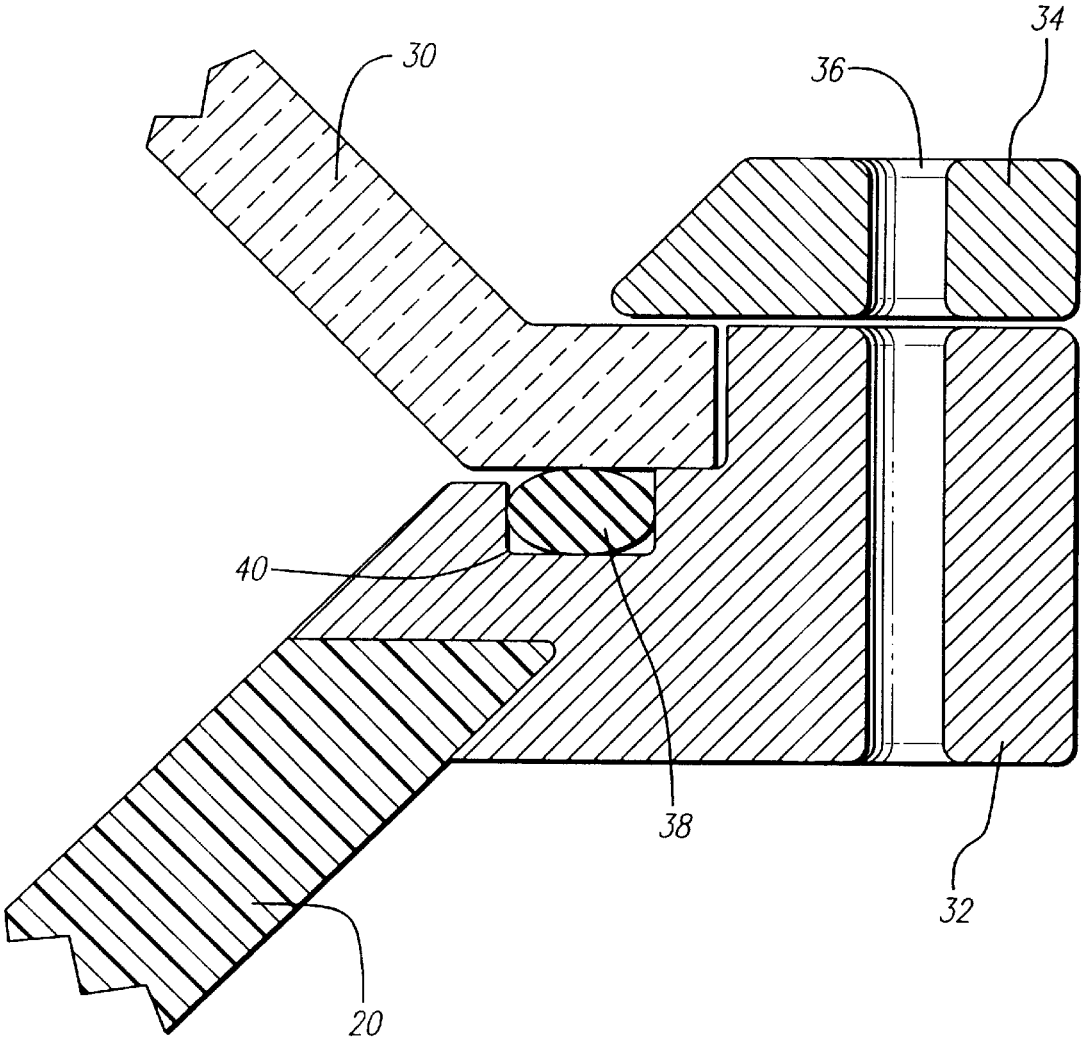
FIG. 3 is a sectional view of a fragment of the inventive antenna showing the flange retaining the outer window thereof.

FIG. 3 is a sectional view of a fragment of the inventive antenna showing the flange retaining the outer window thereof. A clamp ring 34 secures the outer window 30 against an annular O-ring seal 38 disposed in an annular channel 40 of the flange 32 by a plurality caphead bolts (not shown). The flange 32 has an access gap to allow gases trapped in the O-ring channel 40 to escape. Care should be taken in the design to ensure that the flange and the gap do not affect the performance of the antenna, i.e., they should not cause reflections.

The bolts (not shown) are threaded and seat in threads 36 in the clamp ring 34. In the illustrative embodiment, the flange 32 and the clamp ring 34 are made of 6061 aluminum or other suitable material.

In the illustrative application, the antenna 10 is fed with a high power (e.g. 3 gigawatt) $TM_{01}$ mode source (such as a relativistic Klystron amplifier) (not shown) of long pulses (1 microsecond) centered at 1.2 gigahertz with a bandwidth of 3 to 4 percent. The inner window 24 cancels reflections from the outer window 30. Hence, the dual window construction minimizes reflection and exhibits high return losses (e.g. 20 dB or more). The inner and outer windows are designed to provide low loss, good mechanical strength at atmospheric pressure (14.7 pounds per square inch) and reasonably high dielectric constant (e.g. between 2 and 3). The thickness of the inner and outer windows is determined by the wavelength of the radio frequency driving signal in the material and the mechanical strength requirements. The use of plastic windows and a 45 degree cone angle allows for a compact design.

A vacuum is maintained within the antenna as is common in the art. The vacuum is required inside the antenna because the antenna is designed to provide an electric field strength at the output thereof which is just below the threshold at which a breakdown of the air will occur.

The inventive antenna satisfies a unique set of requirements that are encountered when using RF sources capable of producing gigawatt-level microsecond pulses:

1. The outer window must provide a vacuum-tight seal to prevent the leakage of air into the interior of the antenna where the extremely high RF electric fields will ionize the gas disrupting and possibly damaging the RF source.
2. The electric fields radiated by the antenna must be below the level at which they will ionize the surrounding air, i.e., below the air-breakdown limit.
3. The return loss due to reflections from the antenna to the RF source must be greater than 20 dB, as a greater level of reflections may disrupt operation of and may even result in damage to the source that is, the reflected power must be two orders of magnitude below the incident power level so that less than 1% of the radiated power is reflected back into the waveguide that feeds the antenna.
4. The bandwidth of the antenna, defined as the bandwidth over the which Requirement 3 above is satisfied, must be at least 3–5% about the center frequency to accommodate possible uncertainty in the frequency of the high-power RF source.
5. The mechanical strength of the antenna must be sufficient to support the load applied by the ambient air pressure without excessive deformation when the interior of the antenna is evacuated.

The first requirement is met by using standard vacuum practices in constructing the antenna. The window seal is made by using the clamp ring 34 that fits over the outer window 30 and the O-ring 38 that fits in a groove cut into the channel 40. The second requirement is met by spreading the RF power over a sufficient area before allowing it to be radiated into the atmosphere.

Regarding the second requirement, the following equations may be used to calculate the air breakdown limit as a function of pressure and pulse length. Using the criteria set forth in "Generalized Criteria for Microwave Breakdown in Air-filled Waveguides" by Anderson, Lisak, and Lewin [J. Appl. Phys. 65 (8), Apr. 15, 1989], for single-pulse breakdown $$\left(\frac{\nu_i}{p^*} - \frac{\nu_a}{p^*}\right)(p^*\tau) \geq 20, \qquad [3]$$

where $\nu_i$ and $\nu_a$ are the ionization and attachment frequencies, respectively, and p* is the reduced pressure in torr, given by $$p^* = \frac{298}{T}(760). \qquad [4]$$

For T<2000K, the ionization and attachment frequencies $\nu_i$ and $\nu_a$ can be approximated by $$\frac{\nu_i}{p^*} = 5\times10^{11}\exp\left[-73\left(\frac{E_e}{p^*}\right)^{-0.44}\right], \qquad [5]$$

$$\frac{\nu_a}{p^*} = 7.6\times10^{-4}\left[\frac{E_e}{p^*}\left(\frac{E_e}{p^*}+218\right)^2\right],$$

where $$E_e = \frac{E_0/\sqrt{2}}{\sqrt{1+(\omega/\nu_c)^2}} \qquad [6]$$

is the effective electric field strength. Here $\omega=2\pi f$ is the frequency of the incident radiation and $\nu_c$ is the electron collision frequency. The condition for single-pulse breakdown then is:

$$p^*\tau=4\times10^{-11}[\exp(-73\alpha^{-0.44})-1.52\times10^{-15}\alpha^2(\alpha+218)^2]^{-1}, \qquad [7]$$

where $\alpha=E_B/p^*$ (here $E_e$ used in the equations above has been replaced by $E_B$, since $E_B$ is the particular value of $E_e$ at which air breakdown occurs). This equation is valid only for $p^*\lambda \rightarrow 0$. If this is not the case, the following correction must be made to the breakdown condition;

$$\left(\frac{E_B}{p^*}\right)_{p^*\lambda\neq 0} = \left(\frac{E_B}{p^*}\right)_{p^*\lambda=0} - \Delta(p^*\lambda), \quad [8]$$

where $$\Delta(p^*\lambda)=6[1-\exp(-75\times 10^{-3}p^*\lambda)]. \quad [9]$$

Figure 4:
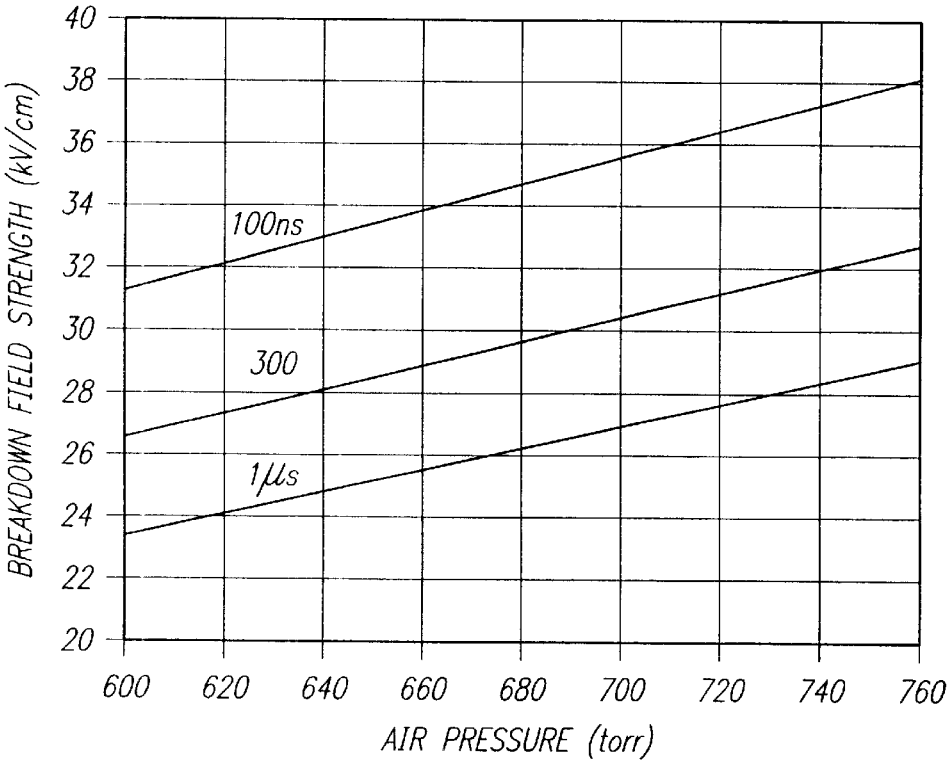
FIG. 4 shows the breakdown electric-field strength as a function of air pressure for three different pulse lengths.

The above correction term is negligible for $p^*\lambda \leqq 614$ torr-cm. At atmospheric pressure and at a frequency of 1.2 GHz ($\lambda$=25 cm), $p^*\lambda$=19000 torr-cm, so that a correction to the breakdown criteria is required. The electric field strength (as opposed to the effective electric field strength) required for air breakdown, $$E_{Break}=\sqrt{2}E_B\sqrt{1+(\omega/\nu_c)^2}, \quad [10]$$

is plotted as a function of air pressure in FIG. 4.

FIG. 4 shows the breakdown electric-field strength as a function of air pressure for three different pulse lengths. As is evident from FIG. 4, the breakdown field for a pulse one microsecond in duration varies from approximately 23.5 kV/cm at pressure of 600 torr to approximately 29 kV/cm at 760 torr (standard atmospheric pressure). Assuming a worst case pressure of 600 torr, and allowing for a factor-of-two margin in terms of power density, the electric field strength must be less than approximately 17 kV/cm at the atmospheric interface.

That is, the maximum altitude at which the antenna is expected to operate is 5000 ft; at this altitude, the air pressure is 632 torr, and the corresponding breakdown threshold is 24.4 kV/cm for 1 $\mu$s pulses. To allow for an adequate safety margin, the aperture diameter of the antenna was chosen so that the power density would be below the air-breakdown limit by a factor of two, or in terms of electric field strength, by a factor of $\sqrt{2}$, corresponding to a maximum electric field strength at the aperture of approximately 17 kV/cm.

The third requirement, that the return loss be greater than 20 dB is met by using a radome consisting of two spherical windows. The thickness of the windows and the separation between them are chosen so that reflections from the two windows nearly cancel. An excellent estimate of the required window dimensions can be had using a simplified model in which the spherical windows are replaced by flat plates and by calculating the return loss using plane waves at normal incidence.

Figure 5:
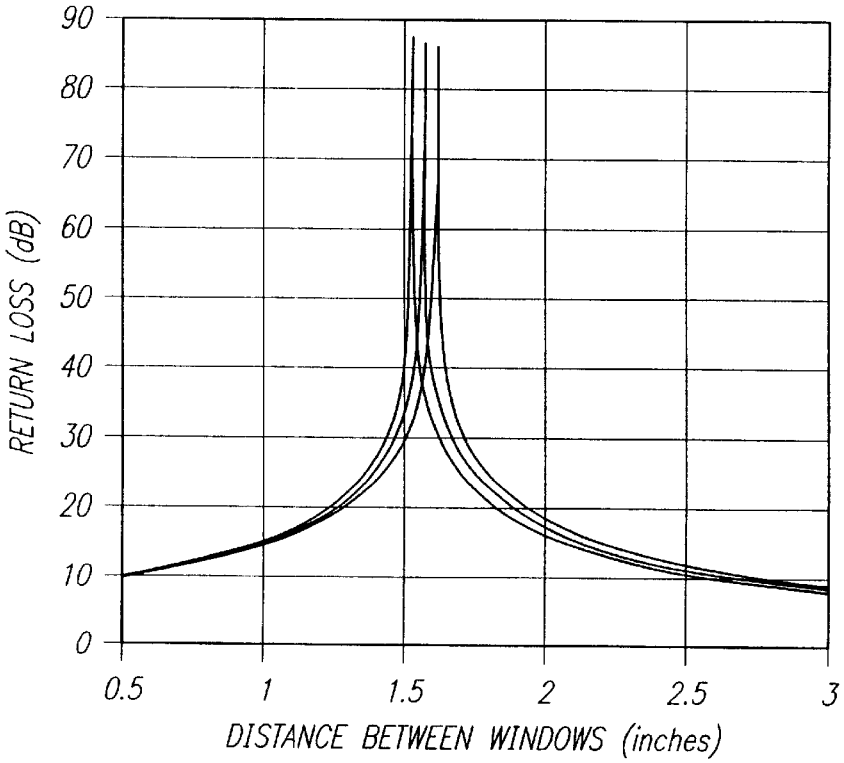
FIG. 5 shows the calculated return loss as a function of window separation at three frequencies for a dual-window radome constructed from half-inch thick sheets of Rexolite.

FIG. 5 shows the calculated return loss as a function of window separation at three frequencies (1.18 GHz, 1.2 GHz, and 1.22 GHz) for a dual-window radome constructed from half-inch thick sheets of Rexolite™ ($\in$=2.62), a readily available, low-loss acrylic polymer with properties similar to the polycarbonate used in the inner and outer windows. (Note that Rexolite is a trade name for a acrylic-type polymer produced by cross-linking polystyrene with divinyl benzene. It is manufactured by C-LEC Plastics and is sold by S & W Plastics, among others.) It is evident that the return loss exceeds the required 20 dB for a considerable range of window separation, implying that the mechanical and material tolerances required to meet this requirement will not be excessive. Indeed fabrication of spherical windows of the required sizes may require "sagging" large sheets of acrylic-based material, which will likely result in some variation in thickness. In addition, there will be variations in the permittivity of the window material, whether it be Rexolite or some other material.

Figure 6:
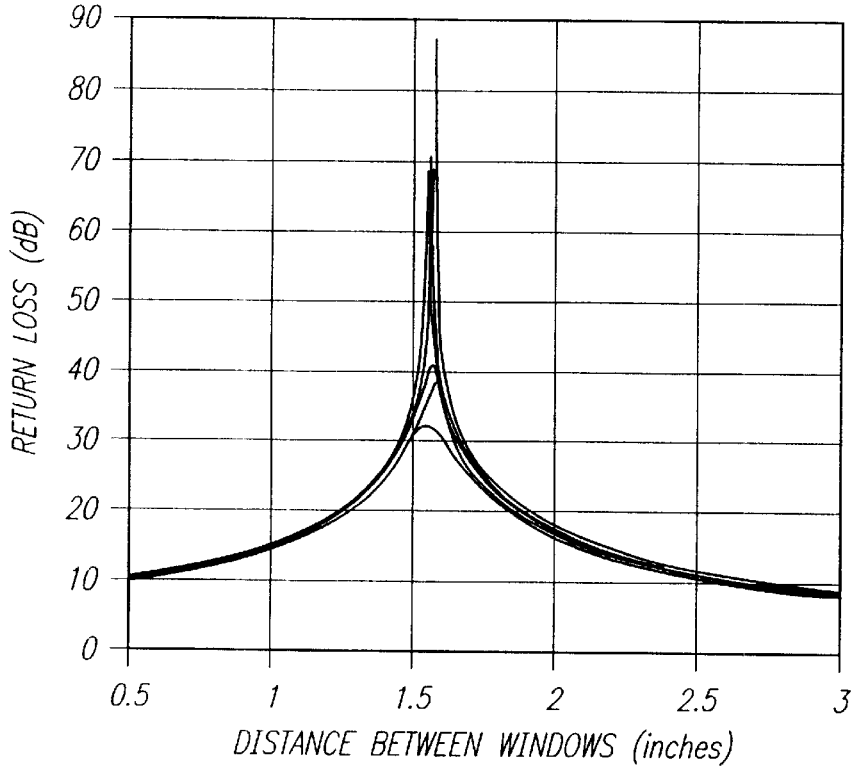
FIG. 6 shows the return loss as a function of window separation at a center frequency of 1.2 GHz for five radomes in which a zero-means gaussian "noise" component having a ±2% variance has been added to the thickness and to the dielectric constant of each of two windows of the antenna of the present invention.

FIG. 6 shows the return loss as a function of window separation at a center frequency of 1.2 GHz for five radomes in which a zero-means gaussian "noise" component having a ×2% variance has been added to the thickness and to the dielectric constant of each of the two windows. For comparison, the return loss of a radome with no added noise is shown in black. While the peak values of the return loss are reduced by 30 dB or more from the peak value attained with no added noise, the window separation range over which the return loss exceeds 20 dB is insensitive to the variations modeled by added noise.

Figure 7:
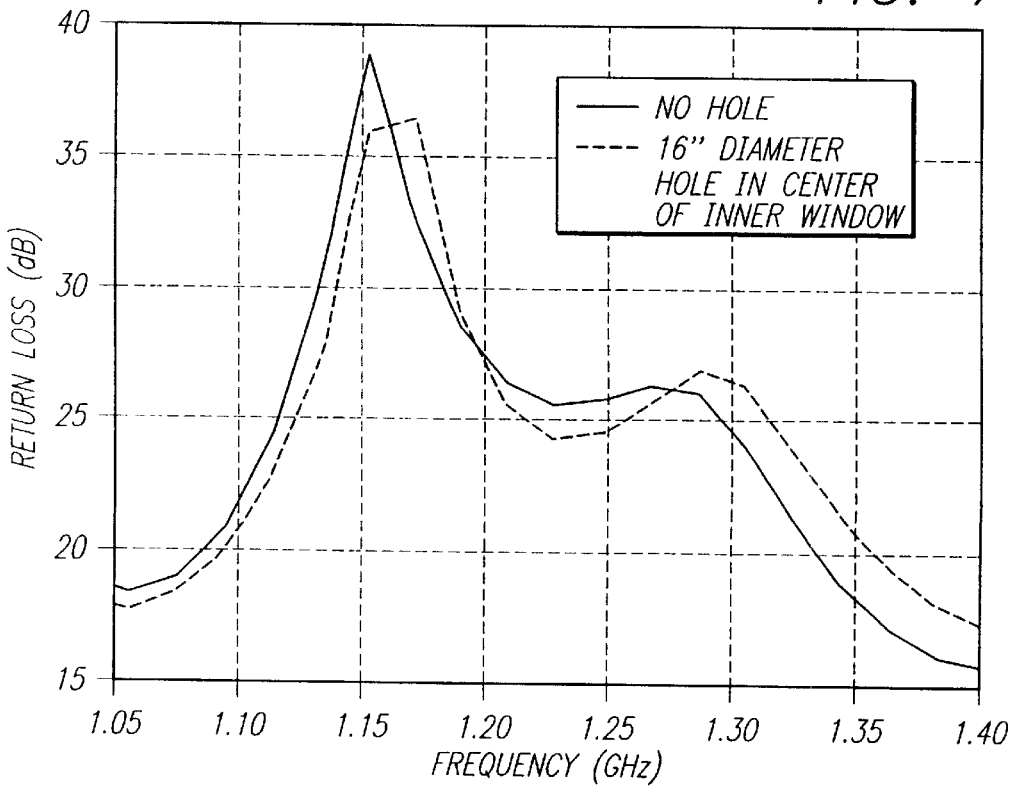
FIG. 7 is a finite-difference time-domain simulation in which the return loss is plotted as a function of frequency for the $TM_{01}$ mode conical horn of the present invention having windows constructed from acrylic sheets.

To meet the fourth requirement, the return loss must exceed 20 dB over a 40 Miz band centered on the center frequency. While the simple model described above indicates that a dual-window radome consisting of two half-inch thick spherical windows separated by 1.57 inch gap will meet the bandwidth requirement, the flat-plate model is not accurate enough to reliably predict the bandwidth of spherical windows. A finite-difference time-domain (FDTD) simulation of the antenna is illustrated FIG. 7 in which the return loss is plotted as a function of frequency for the $TM_{01}$ mode conical horn shown in FIG. 1 and in which the windows are constructed from acrylic sheets ($\in$=2.64, tan $\delta$=0.0006). The parameter $\in$ is the relative permittivity of the material. The speed of light in a material medium is $C/\sqrt{\in}$, where C is the speed of light in free space and tan $\delta$ is the less tangent of the material and is a measure of the attenuation that an electromagnetic wave will experience. With tan $\delta$=0.0006, very little attenuation will occur. The return loss was also calculated using HFSS, a commercial software package sold by Ansoft.

The fifth requirement impacts the design of both the antenna and the outer window. Because the outer window is spherical, the forces due to air pressure are normal to the surface and will not deform the window.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A high power antenna comprising:

a conical horn for receiving an electromagnetic input signal and radiating an output signal in response thereto said conical horn having an waveguide input, an output aperture, and a gradual taper from said waveguide input to said aperture, said taper being tangential to said waveguide input on one end and tangential to said output aperture on the other end thereof;

an inner window disposed within said conical horn; and an outer window mounted at the aperture of said conical horn.

2. The invention of claim 1 wherein said antenna is a $TM_{01}$ mode antenna.

3. The invention of claim 1 including an input flange mounted at said waveguide input of said horn.

4. The invention of claim 3 wherein said horn has a cone angle of 45 degrees.

5. The invention of claim 3 wherein said outer window is disposed at said aperture of said horn.

6. The invention of claim 1 wherein said inner window is a polycarbonate.

7. The invention of claim 6 wherein said outer window is polycarbonate.

8. The invention of claim 1 wherein said inner window has a bore therethrough.

9. A high power $TM_{01}$ mode antenna comprising:

a conical horn having a waveguide input for receiving an electromagnetic input signal and an aperture for radiating an output signal in response thereto, said horn having a gradual taper from said waveguide input to said aperture, said taper having a radius R given by:

$$R = \frac{b\cos\theta_c - \delta\sin\theta_c}{1 - \cos\theta_c}$$

where b is an inner radius of said waveguide input, $\theta_c$ is an angle between an axis of the horn and the side wall of the horn, and $\delta$ is a distance between a projected apex of the horn and a start of a transition section with a height H given by:

$$H = b(1 + \cos\theta_c)\cot\theta_c - \delta\cos\theta_c;$$

an inner window disposed within said conical horn; and an outer window mounted at said aperture of said conical horn.

10. The invention of claim 9 wherein said horn has a cone angle of 45 degrees.

11. The invention of claim 9 wherein said inner window is a polycarbonate.

12. The invention of claim 11 wherein said outer window is polycarbonate.

13. The invention of claim 9 wherein said inner window has a bore therethrough.

* * * * *